United States Patent [19]

Archambault

[11] Patent Number: 4,531,641

[45] Date of Patent: Jul. 30, 1985

[54] DISH RACK AND DRAINBOARD

[76] Inventor: Gene Archambault, 25 Green Acre Dr., Waterbury, Conn. 06705

[21] Appl. No.: 506,056

[22] Filed: Jun. 20, 1983

[51] Int. Cl.[3] ..... A47G 19/08

[52] U.S. Cl. ..... 211/41; 211/208

[58] Field of Search ..... 211/41, 208, 132, 133, 211/128, 11; 206/506; 220/69; 248/439

[56] References Cited

U.S. PATENT DOCUMENTS 1,406,773 2/1922 Stoffel ..... 211/41

1,559,697 11/1925 Henn ..... 248/439

*Primary Examiner*—Ramon S. Britts

*Assistant Examiner*—Blair Johnson

*Attorney, Agent, or Firm*—Lawrence Hager

[57] ABSTRACT

A dish rack and drain board construction including a dish rack supported by integral leg means at a relatively high elevation above and substantially parallel with a sink or support platform and a drain board adjustably mounted for providing an adjustable incline water/debris collection and drainage surface to enable selective rates of draining and/or accommodation with varying sinks and platforms with which the dish rack and drain board may be utilized.

13 Claims, 10 Drawing Figures

DISH RACK AND DRAINBOARD

FIELD OF THE INVENTION

The invention relates to a dish rack and drain board and, in particular, to a dish rack and drain board of improved construction and utility.

BACKGROUND OF THE INVENTION

Typically, a dish drainer is characterized by a drain tray having a predetermined fixed incline surface and a dish rack which is placed on and may be part of the drain tray. The apparent shortcomings of such prior art dish drainers are that water and/or food debris oftentimes stagnates on these prior art drain trays and is difficult and impracticle to extricate without first emptying the dish rack and its removal from being surmounted on the drain tray.

BRIEF STATEMENT OF THE PRIOR ART

Various types of dish drainers have hitherto been proposed.

In one prior art device, such as is described in U.S. Pat. No. 1,835,232 issued Dec. 8, 1931 to Thomas G. Lord, the upper dish drainer is supported on and affixed to a lower drain tray having a fixed inclined surface 3.

Another prior art patent of interest with regard to the present invention is U.S. Pat. No. 1,714,266 issued May 21, 1929 to Charles Ernest Johnson. This reference describes a unitary dish drainer which is supported by an upright member 26 to hold the device 10 at a fixed angularly inclined position when placed on a sink.

Other prior art patents of some interest include U.S. Pat. Nos. 2,807,028 issued Sept. 24, 1957 to Cavanough; 2,443,404 issued June 15, 1948 to Tallarico; and Des. 221,678 issued Aug. 31, 1971 to Goltsegen.

These patents are mentioned as being representative of the prior art and other pertinent patents may exist. None of the above cited patents are deemed to affect the patentability of the present claimed invention.

In contrast to the prior art, the present invention provides a dish rack which is supported by integral leg means at a relatively high elevation above and substantially parallel with the supporting platform or counter-top about a sink, and a discrete drain board which is positioned for providing an adjustable incline drainage surface.

SUMMARY OF THE INVENTION

Generally speaking, in accordance with the invention, a dish/utensil drainer is provided comprising:

A dish/utensil rack adapted for receiving dishes-/utensiles, and having a plurality of integral leg means for supporting said dish/utensil rack at a relatively elevated and generally parallel position above a fixed platform or counter-top, said dish/utensil rack having a bottom wall member containing a plurality of drainage slots; and A drain board having a drainage surface portion readily positionable beneath the drainage slots, and having mounting means to enable selective (user) adjustment of the drainage incline for accommodating various user needs and drainage conditions.

Accordingly, it is an object of the present invention to provide a new and improved dish rack and drain board.

A further object of the invention is to provide a drain board which can be adjustably mounted at selective angles of inclination.

A further object of the invention is to provide a dish rack and drain board which enables adjustment to facilitate drainage and/or removal of any debris which may have potential for stagnating on the drain board.

A further object of the invention is to provide a dish rack and drain board combination which enable tilting and removal of the drain board without emptying the dish rack.

BRIEF DESCRIPTION OF THE DRAWINGS

Other objects and advantages of this invention may be seen more clearly from the following description when viewed in conjunction with the accompanying drawings. Like numerals refer to like parts throughout.

DESCRIPTION OF THE PREFERRED EMBODIMENTS

Figure 1:
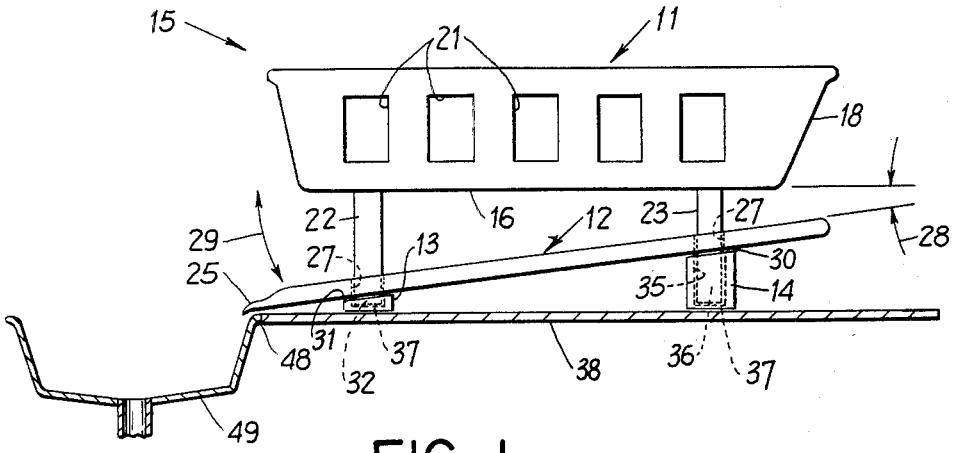
FIG. 1 is a side view of one embodiment of the invention.
Figure 2:
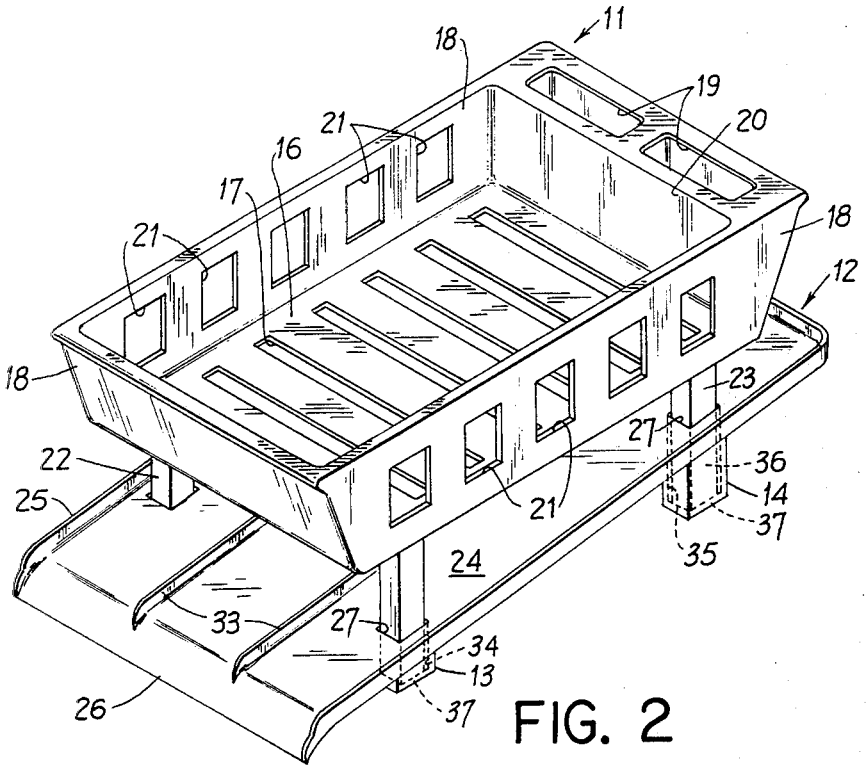
FIG. 2 is a partially exploded perspective view of the dish drainer shown in FIG. 1.

With reference to FIGS. 1 and 2, a first embodiment of the invention is shown as comprising a dish/utensil rack 11, a drain board 12 and a plurality of leg caps 13 and 14. The constituent parts of the dish drainer 15 may be formed of metal, hard rubber, plastic or from various other resins.

The dish/utensil rack 11 includes a bottom member 16 having a plurality of drainage slots or holes 17 and four generally upwardly projecting side walls 18 defining a box or rectangular shaped container being open at its top to enable the placement of dishes and/or utensils (not shown) therewithin. A separate utensil compartment 19 may be formed with the addition of a partition wall 20. A plurality of air venting holes 21 are provided in the side walls 18 to facilitate drying of the dishes placed within rack 11. The rack 11 has four spaced apart legs 22 and 23 projecting downwardly from the bottom member 16. Each leg 22 and 23 has a generally elongated rectangular configuration, for example, of two or more inches in length. The legs 22 and 23 may be integrally formed with the rack 11 or affixed thereto by conventional means.

The drain board or tray 12 includes a rectangular generally flat drainage surface portion 24, a peripheral upwardly projecting ledge 25 forming a water retainer or barrier about three sides of the tray 12, and a contoured tongue portion 26. The drainage surface portion 24 has four spaced apart holes 27 each dimensioned for receiving one of the four respective legs 22 and 23, which extend downwardly through the holes 27. The holes 27 are dimensioned to provide sufficient clearance about the legs 22 and 23 to enable the tray 12 to be placed in an inclined or angular orientation 28 relative to the rack 11. The holes 27 may also be configured to enable the tongue portion 25 and, thereby, tray 12 to be manually upwardly and downwardly disposed, as indicated by the double headed arrow 29, in shaking motion with the rear portion of tray 12 being pivotally supported on the upper ledge 30 of the two rear leg caps 14 (only one shown). The shaking motion with, for example, a banging of tray 12 on the upper ledge 31 of the front leg caps 13 may be effected by an individual to facilitate drainage and debris removal from the surface 24 of tray 12 without removal or emptying of the dish rack 11. A plurality of longitudinal ribs 33 may be integrally formed on the drainage surface portion 24 for providing added rigidity thereto.

A pair of front leg caps 13 (only one shown) are provided each having a leg receiving hole 34. The leg receiving holes 34 are dimensioned to effect a force fit about the bottom leg portion 32 of a respective front leg 22. The front leg caps 13 have a predetermined height for supporting a (front) portion of tray 12 on their upper ledges 31 above platform 38.

A pair of rear leg caps 14 (only one shown) are provided each having a leg receiving hole 35. Each leg receiving hole 35 is dimensioned to effect a force fit about the bottom leg portion 36 of a respective rear leg 23. The rear leg caps 14 have a predetermined height for supporting a (rear) portion of tray 12 on their upper ledges 30 above platform 38.

The leg caps 13 and 14 have their respective holes 34 and 35 extending downwardly to a leg supporting bottom wall 37. The bottom walls 37 of each of the two front and two rear leg caps 13 and 14 have a thickness such that with the respective legs 22 and 23 being fully inserted therein, the height from the bottom of each leg cap 13 and 14 to the bottom member 16 of dish rack 11 is substantially equal (see FIG. 1). In this manner, dish rack 11 is supported at a relatively high elevation above platform or counter-top 38, with its bottom member 16 being thereby disposed substantially parallel to platform 38. The upper ledges 31 and 30 of the front and rear legs 13 and 14, respectively, may be contoured or sloped to correspond with the angle of inclination 28 of tray 12. The angle of inclination 28 is established with use of different height front and rear leg caps 13 and 14 as illustrated in FIG. 1.

The dish drainer 15 may be readily assembled (disassembled) by the user with inserting (removing) each of the four spaced apart legs 22 and 23 through a corresponding aligned hole 27 in tray 12 and thence mounting (removing) a tray retaining/supporting leg cap 13 and 14 on the respective legs 22 and 23.

As noted above, the angle of inclination 28 of tray 12 may be selected or varied with use of leg caps 13 and 14 of different heights or sizes. Several pairs of front and/or rear leg caps of different heights may be provided to enable user selection and adjustment of the angle of inclination 28 and drainage slope relative to the horizontal or platform 38. Alternatively, the holes 34 and 35 may extend through the leg caps 13 and 14, respectively, such that they may be upwardly and downwardly movably mounted on the legs with their vertical disposition being maintained by the force fit (friction engagement) about the respective legs 13 and 14. The bottom of the legs 13 and 14, with use of this alternative embodiment, would be placed in contact with and supported by platform 38.

Figure 3:
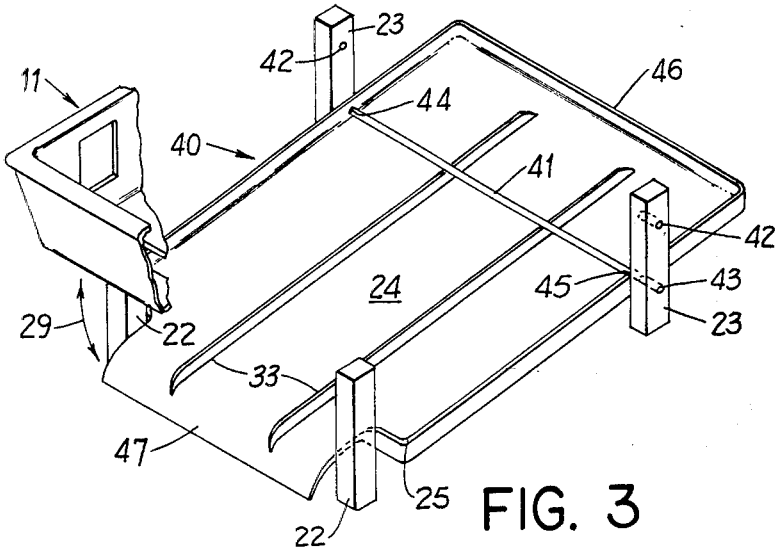
FIG. 3 is a perspective representation, partially cutaway, of an alternative embodiment of a dish drainer in accordance with the invention.

With reference to FIG. 3, another embodiment of the present invention is illustrated which is similar to that shown in FIGS. 1 and 2 with the exception that dish tray 40 is of different configuration and is adjustably pivotally mounted by transverse rod 41. Thus, this embodiment utilizes a transverse rod 41 in place of the leg caps 13 and 14 for attaching the drainage tray to the dish rack. Tray 40 is configured and sized to enable it to be inserted between the front and rear pairs of legs 22 and 23, e.g., from right to left, of the drainer shown in FIG. 3. The rear legs 23 have a plurality of transversely aligned mounting holes 42 and 43. The peripheral ledge contains two transversely aligned tray mounting holes 44 and 45 for receiving rod 41. Each mounting hole 42 and 43 is provided or formed at a different vertical height on the pair of rear legs 23. Since tray 40 is mounted on rod 41, tray 40 is not provided with holes 27.

Generally speaking, and in accordance with the present invention, this embodiment of the dish drainer may be readily assembled, disassembled and drainage incline adjusted to facilitate water and debris removal from tray 40. Tray 40 may be inserted underneath rack 11 and between legs 22 and 23 without need of lifting rack 11 off platform 38. The rear portion 46 is lifted or elevated upwardly to align transverse holes 44 and 45 with a pair of selected transversely aligned holes 42 or 43 provided within each of the rear legs 23. Rod 41 is then transversely inserted within holes 44,45 and, for example, 43. Tongue 47 is contoured to extend over and be supported or rested on the upper rim 48 of sink 49 (see FIG. 1). With rod 41 inserted within and extending between holes 43,44 and 45, tray 40 is pivotally mounted thereon with its rear portion 46 elevated above its front or tongue portion 47. In this manner, a first selectable drainage incline 28 is provided. To change the drainage incline, rod 41 is withdrawn from tray 40 and its rear portion 46 is elevated, for example, manually, to align holes 44 and 45 with leg holes 42. Rod 41 is then inserted within holes 42,44 and 45 for, pivotally mounting tray 40 at the elevated drainage incline (not shown). With tray 40 being pivotally mounted on rod 41, the shaking action noted above is enabled. For example, tongue 47 may be physically grasped and disposed upwardly and downwardly causing tray 40 to pivot about rod 41.

Figure 4:
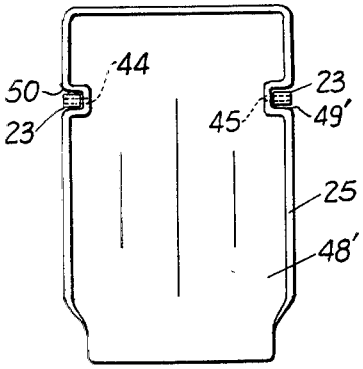
FIG. 4 is a top view of an alternative embodiment of a drain tray.

Referring now to FIG. 4, an alternative embodiment of tray 40 is shown. Tray 48' is similar to that shown in FIG. 3 with the exception that it is of wider dimension and has two slots or alcoves 50' and 50 each sized to receive or straddle a respective rear leg 23.

Figure 5:
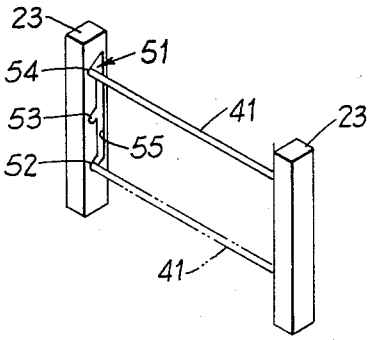
FIG. 5 is a perspective representation of an alternative embodiment of the rear legs shown in FIG. 3 having adjustment slots in accordance with the invention.

Referring to FIG. 5, an alternative tray 40 mounting means is shown. For ease of understanding and illustration, only the rear legs 23 and tray mounting rod 41 are shown, it being understood that in actual operation/use tray 40 would be pivotally mounted on rod 41 as illustrated in FIG. 3. The rear legs 23 are similar to those illustrated in FIG. 3 with the exception that the mounting holes 42 and 43 are replaced by a reversed "E" shaped slot 51. Thus, a mounting slot 51 is provided on the inwardly facing wall of each rear leg 23 between which tray 40 is interposed. Slot 51 has a plurality of downwardly sloping alcoves 52,53 and 54 each forming a different rod (tray 40) mounting position of rod 41. To change the mounting position and, thereby, adjust the angle of inclination 28 of tray 40, rod 41 is pulled upwardly and toward the vertical slot portion 55 of slot 51. With the respective ends of rod 41 aligned (not shown) with the vertical slot portion 55 in each rear leg 23 and without alcove 54, rod 41 may be vertically disposed, for example, downwardly into alignment with alcove 52. Rod 41 (and tray 40) is then pushed or disposed such that its ends are inserted in a pivotal manner within the selected mounting alcove 52 (shown in phantom outline). In this manner, the height of the rear portion 46 of tray 40 may be varied to adjust the angle of inclination 28 of the drainage surface 24.

Figure 6:
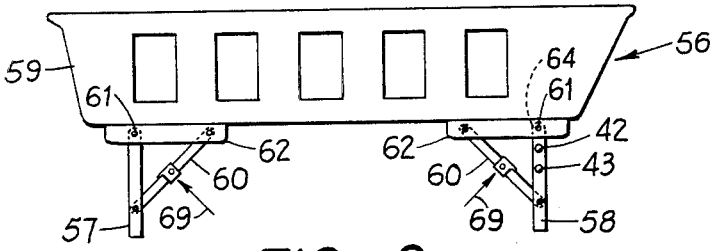
FIG. 6 is a side view of another embodiment of the dish rack in accordance with the invention.
Figure 7:
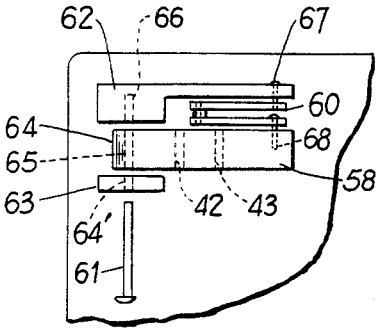
FIG. 7 is a bottom view, partially cutaway, of the dish rack in FIG. 6.

With reference to FIGS. 6 and 7, an alternative embodiment of the dish rack is shown. The dish rack 56 is similar to that shown in FIGS. 1 and 2, with the exception that the front and rear pairs of legs 57 and 58 are collapsibly mounted to the body portion 59 of the dish rack 56 by means of lockable hinges 60 and pivot pins 61. The body portion 59 has walls 62 and 63 projecting downwardly from each corner portion thereof. Each leg 57 and 58 is pivotally mounted at its upper curved end 64 between a pair of respective walls 62 and 63 by means of a pivot pin 61 which is inserted within mounting holes 64',65 and 66. Each lockable hinge 60 is attached by conventional means, for example, rivits or pivot pins 67 and 68. With tray 40 removed from being attached/mounted to the dish rack, the legs 57 and 58 can be folded upwardly as illustrated in FIG. 7 with unlocking hinge 60 by manually pressed inwardly in the direction of arrow 69. In this manner, the dish rack 56 may be collapsed to facilitate storage and/or transport thereof.

Figure 8:
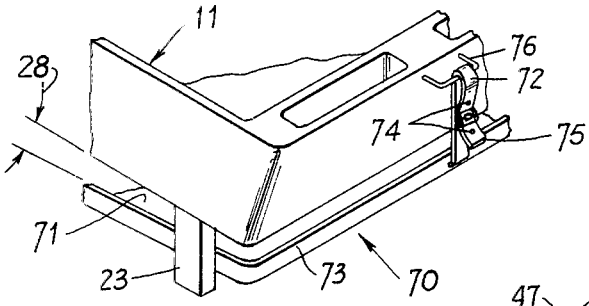
FIG. 8 is a perspective representation, partially cutaway, of an alternative embodiment of a dish drainer in accordance with the invention.

With reference to FIG. 8, another embodiment of the invention is shown. The dish drainer 70 of this embodiment is similar to that of FIG. 3 with the exception that the tray 71 is adjustably mounted to dish rack 11 by means of a strap 72. As noted above, tray 71 is adapted for being insertable between the relatively long front and rear legs 22 and 23 and beneath dish rack 11. A strap 72 is attached at one end to the rear portion 73 of tray 71. Strap or belt 72 may be formed of plastic or other suitable material and has adjustment means, for example, belt buckle and, receiving holes 74 or a snap fastener of conventional design, to enable adjustment of the length of strap 72. The other end 75 of strap 72 is wrapped about a support ring or projection member 76 of rack 11 and is folded over and fastened to a portion of the strap. With adjustment of the length of the folded over strap, the height of the rear portion 73 of tray 71 is varied relative to its tongue 47 (not shown). In this manner, the angle of inclination 28 between tray 71 and rack 11 may be selectively adjusted by the user.

Figure 9:
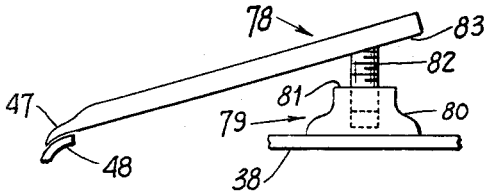
FIG. 9 is a side view of another embodiment of a drain tray in accordance with the invention.

Referring to FIG. 9, another embodiment of a height adjustable drainage tray 78 in accordance with the invention is shown. Tray 78 is configured for being used in conjunction with a dish rack, for example, rack 11, having relatively long or tall legs 22 and 23. Tray 78 is similar to that shown in FIGS. 3 and 8 with the exception that an adjustable pedestal support 79 is utilized instead of leg caps 13,14 (FIG. 1) or rod 41 and holes/-slots (FIGS. 3 and 5) or strap means (FIG. 8). The pedestal support 79 generally comprises a bell shaped base member 80 having an opening 81 at its top which extends downwardly. Opening 81 has internal threaded wall portions for engaging a threaded bolt 82 like downward projection from a rear portion 83 of tray 78. The height of the rear portion 83 relative to its tongue 47 may be adjusted by rotation of base member 80. In this manner, the angle of inclination 28 between the tray 78 and dish rack 11 and/or horizontal may be user selected.

Figure 10:
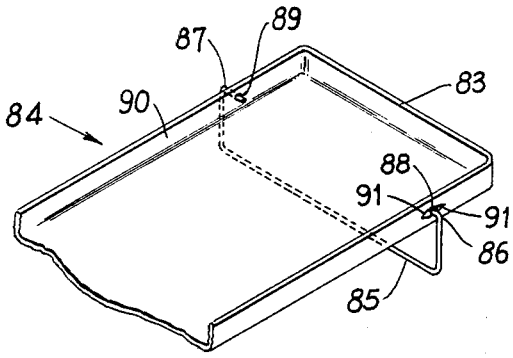
FIG. 10 is another alternative embodiment of a drain tray in accordance with the invention.

With reference now to FIG. 10, another embodiment of a height adjustable drainage tray 84 in accordance with the invention is shown. As with the above embodiments, tray 84 is configured for being used in conjunction with a dish rack having relatively long legs (22 and 23) which support the rack at a relatively high elevation above a platform 38. Tray 84 is similar to that shown in FIG. 9 with the exception that a multi-position U-shaped support bar 85 is utilized instead of the pedestal support 78. Support bar 85 has a portion which extends transversly and beneath tray 84 and is supported upon platform 38 for elevating its rear portion 83 above platform 38. Each end 86 and 87 of support bar 85 is rotatably received/mounted within a hole 88 and 89, respectively, within the side walls of rim 90. A plurality of ridges or dimples 91 may be provided on at least on side of rim 90 for engaging with a portion of the support bar 85 to enable selective positioning of bar 85 for enabling height adjustment of the rear portion 83 relative to platform 38. Thus, with the tongue portion 47 (not shown) supported on rim 48 of a sink, the angle of inclination 28 of drainage surface 24 may be selectively varied.

It is to be understood that the above described embodiments are illustrative of the principles of the invention. Other embodiments may be devised by those skilled in the art without departing from the spirit and scope of the invention.

I claim:

1. A drainer having particular utility for being surmountable on a platform to enable stacking of wet items for drip drying and to facilitate drainage, comprising:

rack means configured for receiving the items therewithin and having a plurality of drain holes;

a front pair and a rear pair of spaced apart leg means affixed to said rack means and being dimensioned so that with surmounting on the platform said rack means being relatively distally mounted above the platform;

drain board means configured for being positionable beneath and removable from said rack means without necessitating a dislocating of the surmounting of said rack means upon the platform.

2. A drainer as in claim 1, wherein:

the drain board means includes mounting means for selecting a plurality of incline mounting positions.

3. A drainer as in claim 1, wherein:

the drain board means is mounted beneath said rack means so as to enable a shaking motion of said drain board means to facilitate drainage and/or debris extrication therefrom.

4. A dish drainer comprising:

dish rack means for receiving dishes and having a water drainage slot;

a plurality of spaced apart support leg means affixed to said dish rack means;

drain board means having a drainage surface portion positionable beneath the water drainage slot, and having mounting means to enable disposing of said drainage surface portion at a plurality of drainage inclines with said drain board means being pivotally mounted to enable shakable motion of the drain board means.

5. A dish drainer as in claim 4, wherein:

the leg means are dimensioned for supporting the dish rack means at a relatively high elevation above a platform upon which the dish drainer is disposed.

6. A dish drainer as in claim 4, wherein:

the leg means comprises a pair of front legs and a pair of rear legs, said pair of rear legs each have a plurality of aligned transverse holes;

the drain board means is dimensioned for being readily insertable between the leg means and beneath said dish rack means, said drain board means includes a portion having a rod receiving hole; and a rod means insertable within a pair of aligned transverse holes and the rod receiving hole whereby said drain board means is pivotally mounted to the pair of rear legs.

7. A dish drainer as in claim 6, wherein:

the rod means being insertable within different pairs of aligned transverse holes for effecting various angles of inclination of the drainage surface portion.

8. A dish drainer as in claim 6, wherein:

the drain board means has an alcove within two opposite side wall portions each for accommodating a portion of a respective rear leg.

9. A dish drainer as in claim 4, wherein:

the leg means comprises a pair of spaced front legs and a pair of spaced rear legs, said pair of rear legs each having a plurality of slots, each slot within a rear leg being aligned with a slot within the other rear leg for forming a plurality of pairs of transversly aligned rod mounting slots with each pair of slots being at a different height/longitudinal disposition;

the drain board means comprises a generally flat rectangular member having a front tongue portion interpositionable between said front legs and having a rod bracket approximately at a rear end portion, said rear end portion being interpositionable between said rear legs; and an elongate rod means mountable to said rod bracket and selectively to each pair of said slots whereby the drain board means is pivotally mountable between the front and rear legs with the rear end portion being disposable at selectable distances beneath the dish rack means.

10. A dish drainer as in claim 4, wherein:

the leg means are hinge mounted to the dish rack means.

11. A dish drainer as in claim 4, wherein:

the dish rack means includes a strap mounting bracket; and the drain board means includes a strap being affixed to the drain board means and engagable with the strap mounting bracket for supportively mounting a rear portion of the drain board means to the dish rack means, said strap having adjustment means for varying the height of the rear portion of the drain board means relative to the dish rack means.

12. A dish drainer as in claim 4, wherein:

the drain board means includes a rear end portion mounted on a height adjustable pedestal like stand.

13. A dish drainer as in claim 4, wherein:

the mounting means and the drain board means are configured and adapted to permit the drain board means to be readily insertable and abstractable from beneath and without prior relocation of the dish rack means.

* * * * *